US006899548B2

(12) United States Patent
Houtz

(10) Patent No.: US 6,899,548 B2
(45) Date of Patent: May 31, 2005

(54) ELECTRICAL CONNECTOR HAVING A CORED CONTACT ASSEMBLY

(75) Inventor: Timothy W. Houtz, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 15 days.

(21) Appl. No.: 10/232,883

(22) Filed: Aug. 30, 2002

(65) Prior Publication Data

US 2004/0043648 A1 Mar. 4, 2004

(51) Int. Cl.[7] ..... H01R 12/00; H01R 13/648

(52) U.S. Cl. ..... 439/71; 439/79; 439/608

(58) Field of Search ..... 439/71, 79, 590, 439/856–857, 937, 608

(56) References Cited

U.S. PATENT DOCUMENTS

| | | | | | |
|---|---|---|---|---|---|
| 3,669,054 | A | | 6/1972 | Desso et al. | 113/119 |
| 3,748,633 | A | | 7/1973 | Lundergan | 339/217 S |
| 4,260,212 | A | | 4/1981 | Ritchie et al. | 339/97 R |
| 4,288,139 | A | | 9/1981 | Cobaugh et al. | 339/74 R |
| 4,717,360 | A | * | 1/1988 | Czaja | 439/710 |
| 4,776,803 | A | | 10/1988 | Pretchel et al. | 439/59 |
| 5,077,893 | A | | 1/1992 | Mosquera et al. | 29/882 |
| 5,174,770 | A | | 12/1992 | Sasaki et al. | 439/108 |
| 5,274,918 | A | | 1/1994 | Reed | 29/882 |
| 5,590,463 | A | | 1/1997 | Feldman et al. | 29/844 |
| 5,609,502 | A | | 3/1997 | Thumma | 439/747 |
| 5,741,144 | A | | 4/1998 | Elco et al. | 439/101 |
| 5,741,161 | A | * | 4/1998 | Cahaly et al. | 439/709 |
| 5,795,191 | A | | 8/1998 | Preputnick et al. | 439/608 |
| 5,908,333 | A | * | 6/1999 | Perino et al. | 439/631 |
| 5,961,355 | A | | 10/1999 | Morlion et al. | 439/686 |
| 6,068,520 | A | | 5/2000 | Winings et al. | 439/676 |
| 6,125,535 | A | | 10/2000 | Chiou et al. | 29/883 |
| 6,146,157 | A | | 11/2000 | Lenoir et al. | 439/101 |
| 6,146,203 | A | | 11/2000 | Elco et al. | 439/609 |
| 6,190,213 | B1 | | 2/2001 | Reichart et al. | 439/736 |
| 6,212,755 | B1 | | 4/2001 | Shimada et al. | 29/527.1 |
| 6,219,913 | B1 | | 4/2001 | Uchiyama | 29/883 |
| 6,269,539 | B1 | | 8/2001 | Takahashi et al. | 29/883 |
| 6,319,075 | B1 | * | 11/2001 | Clark et al. | 439/825 |
| 6,328,602 | B1 | | 12/2001 | Yamasaki et al. | 439/608 |
| 6,363,607 | B1 | | 4/2002 | Chen et al. | 29/883 |
| 6,506,081 | B2 | * | 1/2003 | Blanchfield et al. | 439/682 |
| 6,537,111 | B2 | * | 3/2003 | Brammer et al. | 439/857 |
| 6,652,318 | B1 | * | 11/2003 | Winings et al. | 439/608 |
| 2001/0010979 | A1 | * | 8/2001 | Ortega et al. | 439/79 |

* cited by examiner

*Primary Examiner*—Michael C. Zarroli
(74) *Attorney, Agent, or Firm*—Woodcock Washburn LLP

(57) ABSTRACT

A contact assembly including an insert molded contact block, a plurality of dual beam signal contact terminals extending through the contact block and a plurality of dual beam ground contact terminals extending through the contact block wherein a portion of each ground contact terminals has an encapsulated formed area within the contact block. The contact block includes a core disposed between the beams of each of the second plurality of dual beam contact terminals.

23 Claims, 11 Drawing Sheets

ELECTRICAL CONNECTOR HAVING A CORED CONTACT ASSEMBLY

CROSS REFERENCE TO RELATED APPLICATIONS

The present invention relates to U.S. patent application having Ser. No. 10/155,786 filed May 24, 2002 entitled CROSS-TALK CANCELING TECHNIQUE FOR HIGH SPEED ELECTRICAL CONNECTORS and U.S. patent application having Ser. No. 10/232,353 filed Aug. 30, 2002 entitled CONNECTOR RECEPTACLE HAVING A SHORT BEAM AND LONG WIPE DUAL BEAM CONTACT, both of which are assigned to the assignee of the present application.

FIELD OF THE INVENTION

This invention relates to electrical connectors. More particularly, this invention relates to an electrical connector having a cored contact assembly.

BACKGROUND OF THE INVENTION

Electrical connectors are typically used to connect multiple electrical devices such that the electrical devices may electrically communicate. Typically, electrical connectors include ground contacts and signal contacts. The signal contacts pass electrical signals from device to device whereas the ground contacts typically function to aid in ensuring high signal integrity, among other functions.

In some certain applications, the ground contacts on an electrical connector may be longer in length than the signal contacts within the same connector. This may be the case for several reasons. For example, when mating two devices, some applications require the ground contacts to mate first. In this manner, when inserting the first device into the second device, the longer ground contacts will mate before the shorter signal contacts.

However, as a contact terminal increases in length, the spring rate of the contact terminal decreases. The spring rate of a contact terminal is defined as how much force is required to deflect the contact a distance, and is measured in force per unit distance. Thus, a terminal having a lower spring rate is deflected farther than a terminal having a higher spring rate when equal force is applied thereto. Generally, terminals in a connector must have a determined spring rate for proper mating.

Consequently, a need exists for an improved electrical connector that satisfies the aforementioned needs.

BRIEF SUMMARY OF THE INVENTION

The invention provides an electrical connector with a cored contact assembly. By coring the contact assembly, the contact assembly can mate with a connector that has contacts of varying length. Furthermore, by adjusting the depth of the core in the contact block, the spring rate of the contact terminals adjacent to the core can be adjusted. Coring the contact assembly also provides enough contact wipe for proper electrical connection to be made between the electrical connector with a cored contact assembly and another electrical connecter.

The invention, among other things, provides an improved contact assembly that, in one embodiment, includes an insert molded contact block, a plurality of dual beam signal contact terminals extending through the contact block and a plurality of dual beam ground contact terminals extending through the contact block wherein a portion of each ground contact terminals has an encapsulated formed area within the contact block. The contact block includes a core disposed between the beams of each of the second plurality of dual beam contact terminals.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF THE INVENTION

Figure 1:
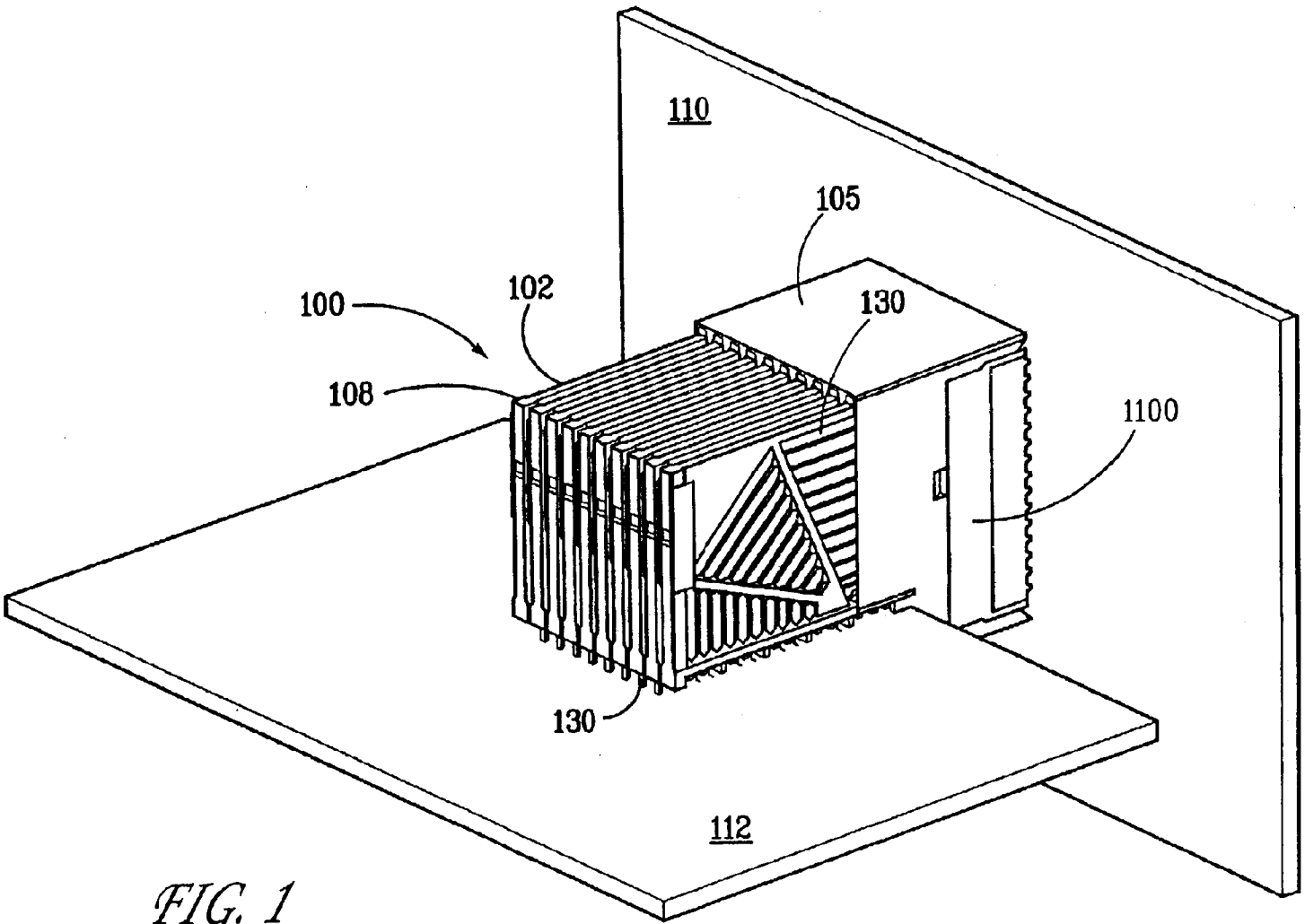
FIG. 1 is a perspective view of a backplane system having an exemplary right angle electrical connector in accordance with the invention.

FIG. 1 is a perspective view of a backplane system having an exemplary right angle electrical connector in accordance with an embodiment of the invention. However, the invention may take other forms such as a vertical or horizontal electrical connector. As shown in FIG. 1, connector 100 comprises a plug 102 and receptacle 1100.

Plug 102 comprises housing 105 and a plurality of lead assemblies 108. The housing 105 is configured to contain and align the plurality of lead assemblies 108 such that an electrical connection suitable for signal communication is made between a first electrical device 112 and a second electrical device 110 via receptacle 1100. In one embodiment of the invention, electrical device 110 is a backplane and electrical device 112 is a daughtercard. Electrical devices 110 and 112 may, however, be any electrical device without departing from the scope of the invention.

As shown, the connector 102 comprises a plurality of lead assemblies 108. Each lead assembly 108 comprises a column of terminals or conductors 130 therein as will be described below. Each lead assembly 108 comprises any number of terminals 130.

Figure 1A:
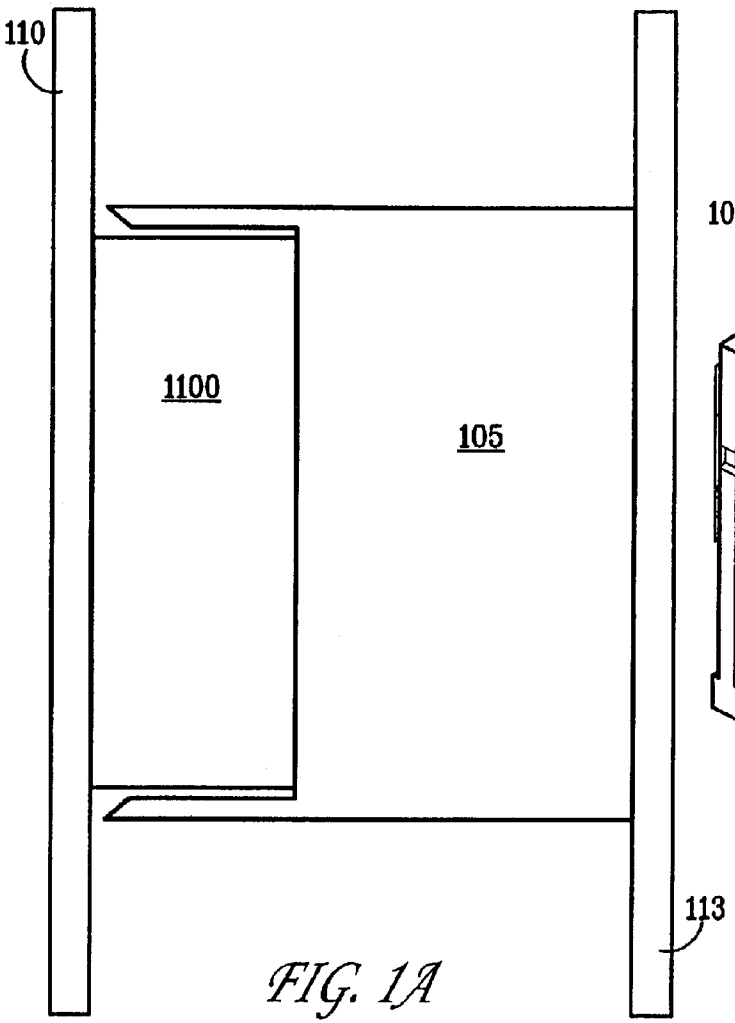
FIG. 1*a* is a simplified view of a board-to-board system having a vertical connector in accordance with the invention.

FIG. 1*a* is a board-to-board system similar to FIG. 1 except plug connector 106 is a vertical plug connector rather than a right angle plug connector. This embodiment makes electrical connection between two parallel electrical devices 110 and 113.

Figure 2:
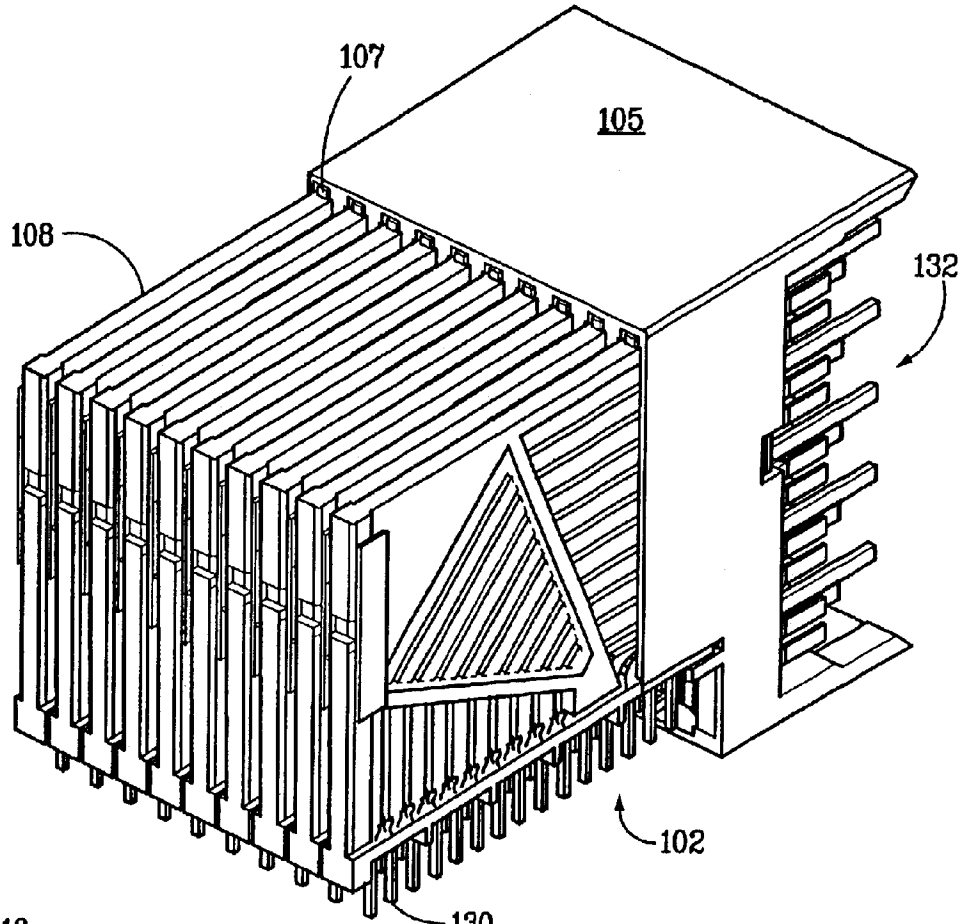
FIG. 2 is a perspective view of the connector plug portion of the connector shown in FIG. 1.

FIG. 2 is a perspective view of the plug connector 102 of FIG. 1 shown without electrical devices 110 and 112 and receptacle connector 1100. As shown, slots 107 are formed in the housing 105 that contain and align the lead assemblies 108 therein. In one embodiment, the housing 105 is made of plastic, however, any suitable material may be used without departing from the scope of the invention. FIG. 2 also shows connection pins 130, 132. Connection pins 130 connect connector 102 to electrical device 112. Connection pins 132 electrically connect connector 102 to electrical device 110 via receptacle 1100. Connection pins 142 may be adapted to provide through-mount or surface-mount connections to an electrical device (not shown).

Figure 3:
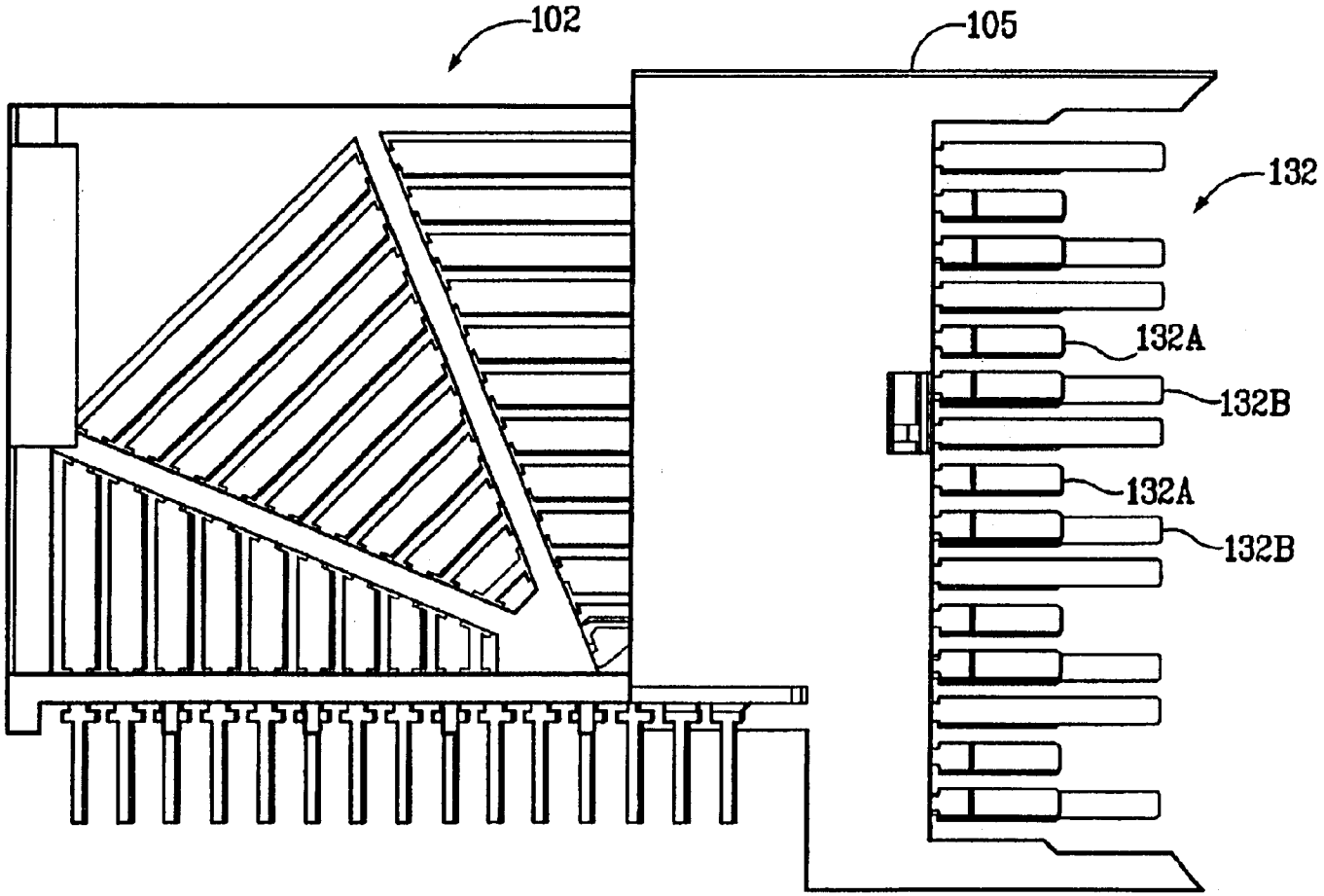
FIG. 3 is a side view of the connector plug portion of the connector shown in FIG. 1.

FIG. 3 is a side view of plug connector 102 as shown in FIG. 2. As shown, in this configuration, the terminals 132 used to connect to receptacle 1100 vary in length, i.e. the terminals extend in varied lengths from the end of the housing 105 from which the terminals 132 extend. For example, as shown, ground terminals 132B extend a greater distance from housing 105 than signal terminals 132A. During mating of the connector plug 102 to receptacle 1100, such configuration provides that the longer ground terminals 132B on plug 102 will mate with the corresponding ground terminals on the receptacle 1100 before the shorter signal terminals 132A mate with the corresponding signal terminals 1175A on the receptacle 1100. Such a configuration can be used to ensure that signal integrity is maintained when plug 102 is mated with receptacle 1100.

Figure 4:
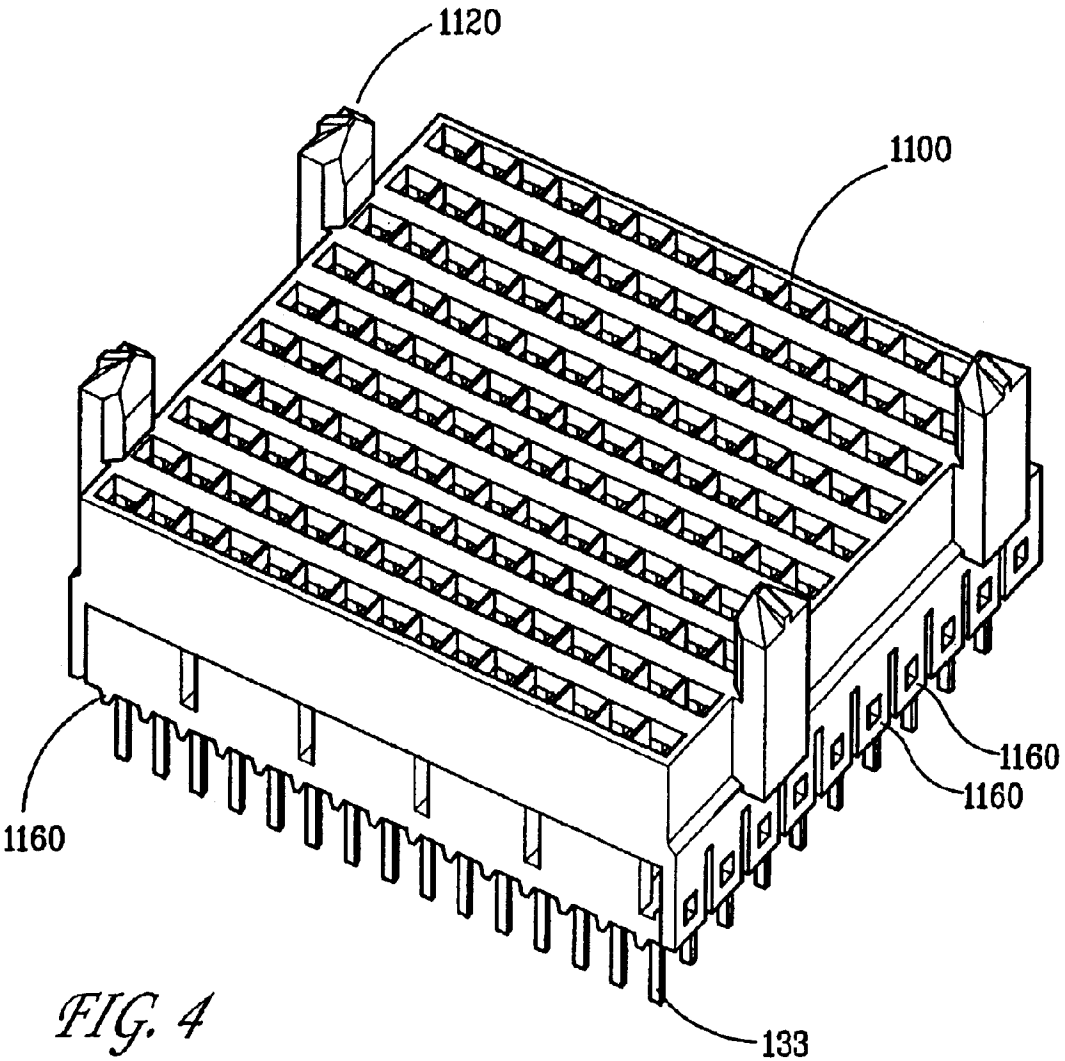
FIG. 4 is a perspective view of the receptacle portion of the connector shown in FIG. 1.
Figure 5:
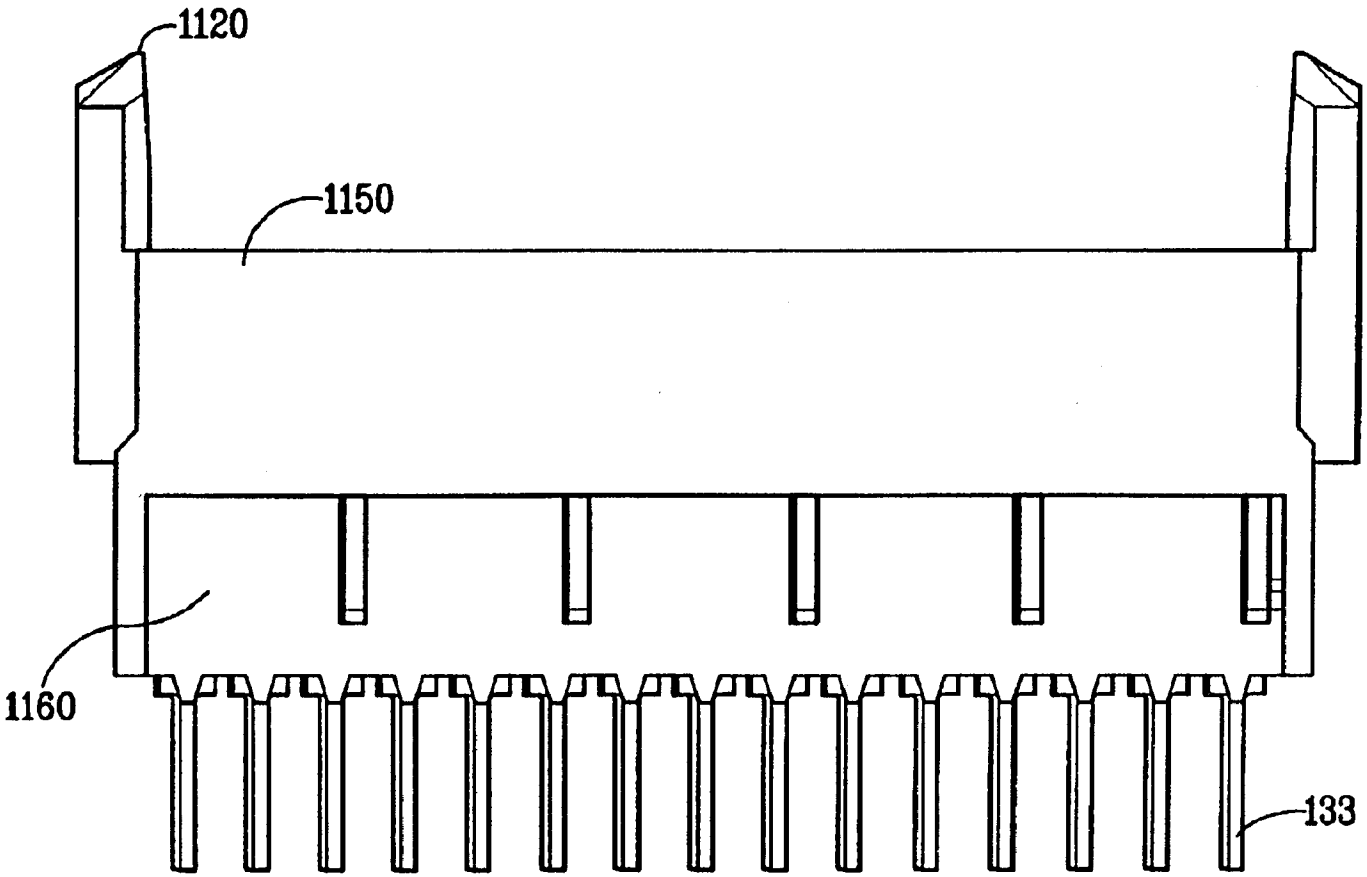
FIG. 5 is a side view of the receptacle portion of the connector shown in FIG. 4.

FIGS. 4 and 5 are a perspective view and side view, respectively, of the receptacle 1100 portion of the connector shown in FIG. 1. In this manner, receptacle 1100 may be mated with connector plug 102 (as shown in FIG. 1) and used to connect two electrical devices (as shown in FIG. 1). Specifically, connection pins or contact terminals 133 (as shown in FIG. 1) may be inserted into, for example, vias (not shown) on device 110 to electrically connect connector plug 102 to device 110. In another embodiment of the invention, the connection pins 133 may be eye-of-the-needle pins for use in press-fit applications or a surface mount configuration.

Receptacle 1100 also includes alignment structures 1120 to aid in the alignment and insertion of connector plug 102 into receptacle 1100. Once inserted, structures 1120 also serve to secure the connector plug in receptacle 1100. Such structures 1120 thereby resist any movement that may occur between the connector and receptacle that could result in mechanical breakage therebetween.

Receptacle 1100 includes a plurality of receptacle contact assemblies 1160 each containing a plurality of terminals 133 (only the tails of which are shown in FIG. 4) configured in rows. The terminals 133 provide the electrical pathway between the connector 100 and any mated electrical device (not shown).

Figure 6:
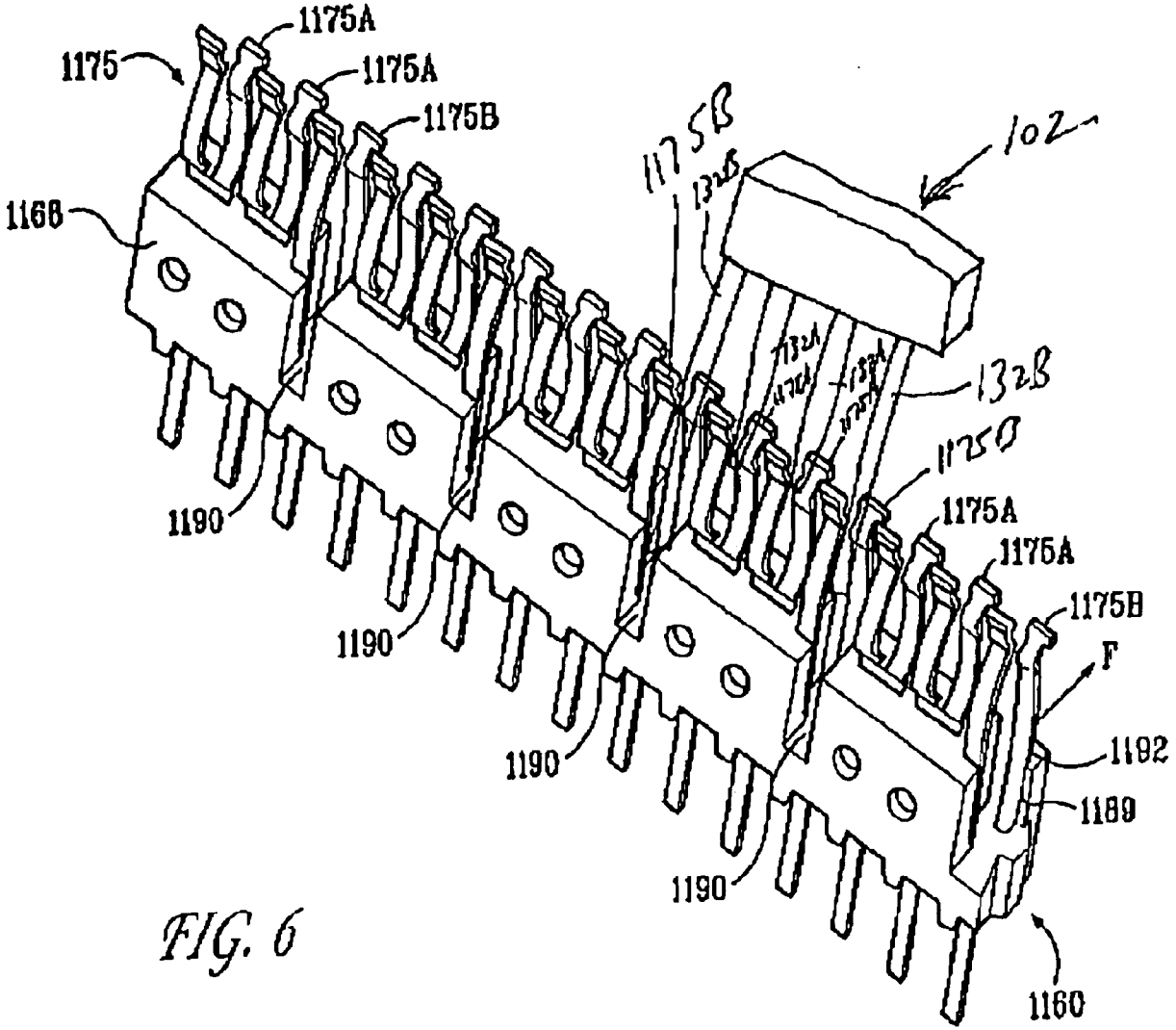
FIG. 6 is a perspective view of a contact assembly in accordance with one aspect of the invention.

FIG. 6 is a perspective view of a single receptacle contact assembly in accordance with one aspect of the invention and not contained in receptacle housing 1150. As shown, the assembly 1160 includes a plurality of dual beam conductive contact terminals 1175 extending through a contact block 1168. The contact block is typically made from an insulating material. As shown in FIG. 6, and in one embodiment of the invention, contact terminals comprise ground contact terminals 1175B and signal contact terminals 1175A and are configured within the contact block 1168 in a signal-signal-ground configuration. To illustrate, starting from the left hand portion of the assembly 1160, the first and second terminals are signal contacts 1175A and the third terminal is a ground terminal 1175B, such contact pattern continues along the length of the assembly 1160. Also as shown in FIG. 6, the assembly contains five sets of terminals, each set in a signal-signal-ground configuration.

As shown, the signal contact terminals 1175A have a dual beam configuration on one side of the contact block 1168 and a straight pin configuration on the other side of the contact block 1168. In another embodiment of the invention, the straight pin configuration of the signal contacts 1175A could be replaced with an eye-of-the-needle configuration for press fit applications or a surface mount configuration.

Also, as shown, the ground contact terminals 1175B have a dual beam configuration on one side of the contact block 1168 and a straight pin configuration on the other side of the contact block 1168. In another embodiment of the invention, the straight pin configuration of the ground contacts 1175B could be replaced with an eye-of-the-needle configuration for press fit applications or a surface mount configuration.

In accordance with one aspect of the invention, the contact block 1168 includes cores 1190. The cores 1190 may be wells or portions of the contact block 1168 that are cut out to allow the shorter signal contacts 132A of the plug 102 to mate with the signal contacts 1175A of the receptacle 1100 in such a way that the ground contacts 132B do not interfere with or prematurely bottom out on the contact block 1168. In one embodiment of the invention and as shown in FIG. 6, the cores 1190 are located between the dual beams of ground contacts 1175B.

In this manner, when plug 102 is inserted into receptacle 1100, the ground contacts 132B of the plug are first to contact the dual beams of the ground terminals 1175B. This occurs because the ground contacts 132B extend farther from the plug housing 105 than the signal contacts 132A, as described above. Thereafter, the ground contacts 132B extend between the dual beams of ground contact 1175B and are inserted into cores 1190. The shorter signal contacts 132A then contact the signal contacts 1175A in the receptacle. By providing cores between the dual beams of ground contact 1175B, the shorter signal contacts 132A of the plug 102 can mate with the signal contacts 1175A of the receptacle 1100 in such a way that ground contacts 132B do not interfere with or prematurely bottom out on contact block 1168.

Further, by providing cores 1190 between the dual beams of ground contact 1175B, the spring rate of ground contact 1175B can be controlled to provide a desired spring rate. As addressed above, the spring rate of ground contact 1175B is defined as the distance the contact moves (deflection) when force is applied thereto.

To illustrate, when a ground contact 132B is inserted into ground contact 1175B, the force of the insertion deflects ground contact 1175B in a direction indicated by arrow F as shown in FIG. 6. Typically, such direction is normal to the length of the ground terminal 1175B. The spring rate of ground contact 1175B is controlled by the fulcrum point 1192. In the embodiments shown in FIGS. 6 and 7, the fulcrum point 1192 is the uppermost point of core sidewall 1189 where the ground contact 1175B contacts the contact block 1168 and serves as the fulcrum when a contact is inserted into the dual beam ground contact. For example, in one embodiment, the tooling used to form the core can be adjusted independently of tooling used to form the fulcrum point on the sidewall. For example, each of these specifications can correspond to a customer specification.

Figure 8:
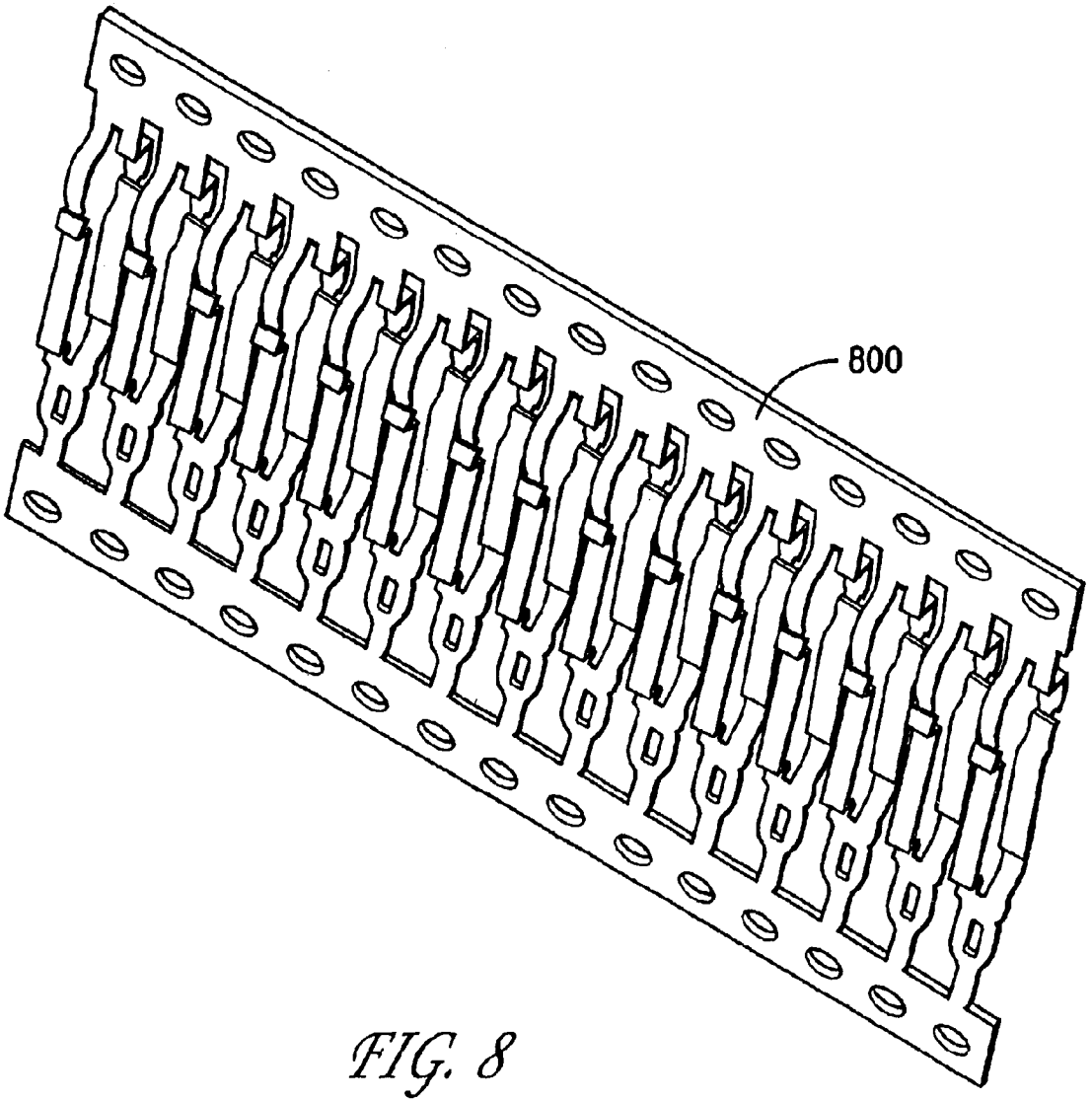
FIG. 8 is a perspective view of a row of stamped contact terminals that may be used to form a contact assembly in accordance with the invention.

In one embodiment of the invention, the contact block 1168 and cores 1190 are formed using insert molding. In this manner, a row of stamped contact terminals 800, as shown in FIG. 8, are inserted into a mold cavity and core pins are used to contain and position the row of terminals in a precise location. The core pins are also used to form cores 1190, which will be described in more detail below.

Thereafter, once the contacts and core pins are positioned, molten plastic is injected into the mold cavity and allowed to form around the contacts and core pins. The molten plastic is then cooled and the core pins and the mold are removed. The result is a plastic contact block having cores 1190 with a desired position and depth and encapsulating the row of contacts.

It is also contemplated that varying the depth of cores 1190 in contact block 1168 provides for a desired contact wipe. Contact wipe is a deviation parameter used to allow for curvatures that may exist in an electrical device that results in non-simultaneous contact mating when connectors are mated. In this manner, increasing the depth of the core allows for greater contact wipe.

In one embodiment, a discrete set of cores are formed in the contact block using core pins. In this manner, the core pins are positioned in discrete positions in the center of the contact row and at a determined depth and position that will result in discrete cores within the contact block having a desired depth and position. Again, in one embodiment, the cores are positioned between the dual beams of ground contacts 1175B as shown in FIG. 6 and are adapted to receive ground contacts 132B of plug connector 102.

Figure 9:
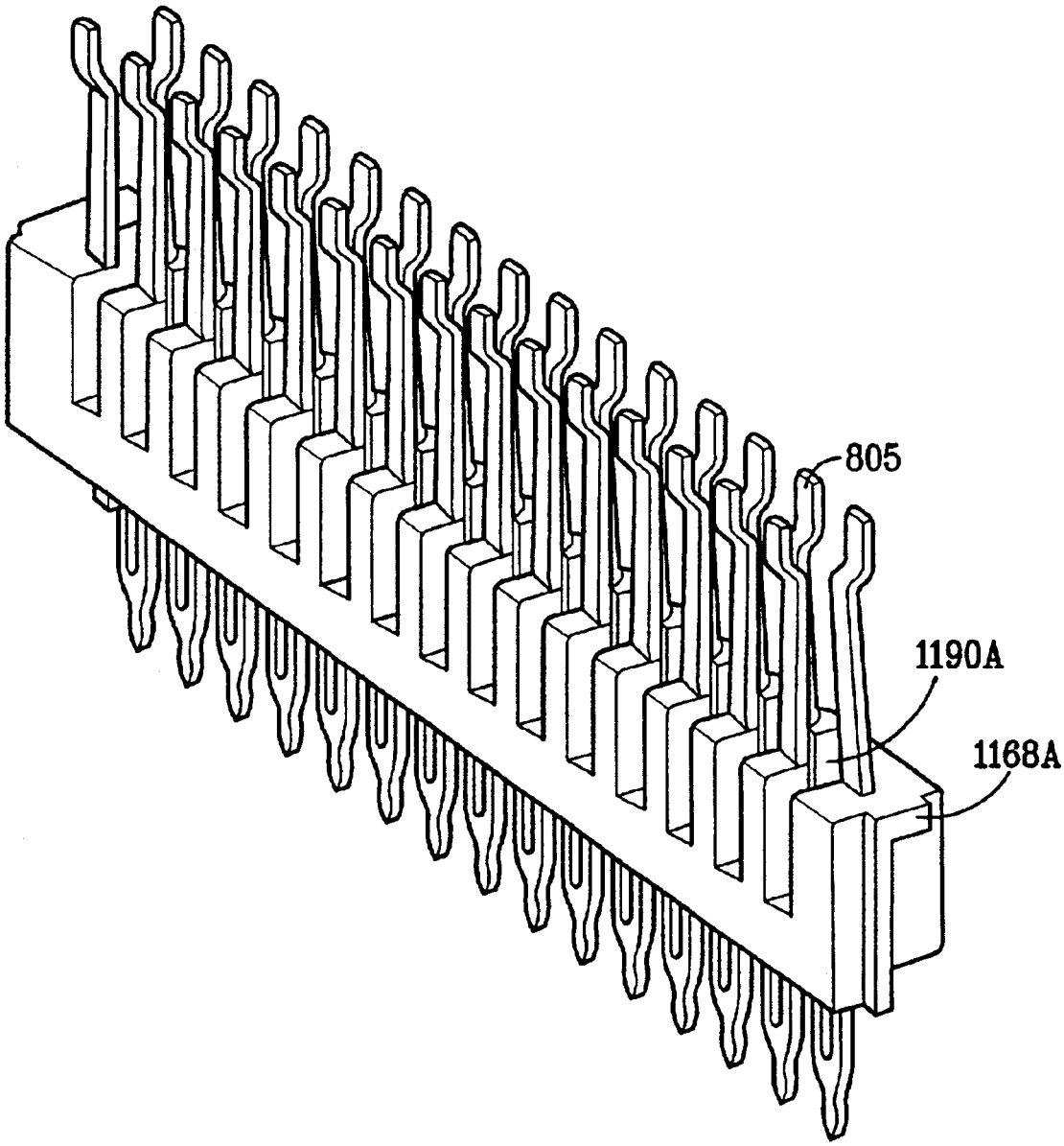
FIG. 9 is a perspective view of a contact assembly in accordance with another embodiment of the invention.
Figure 10:
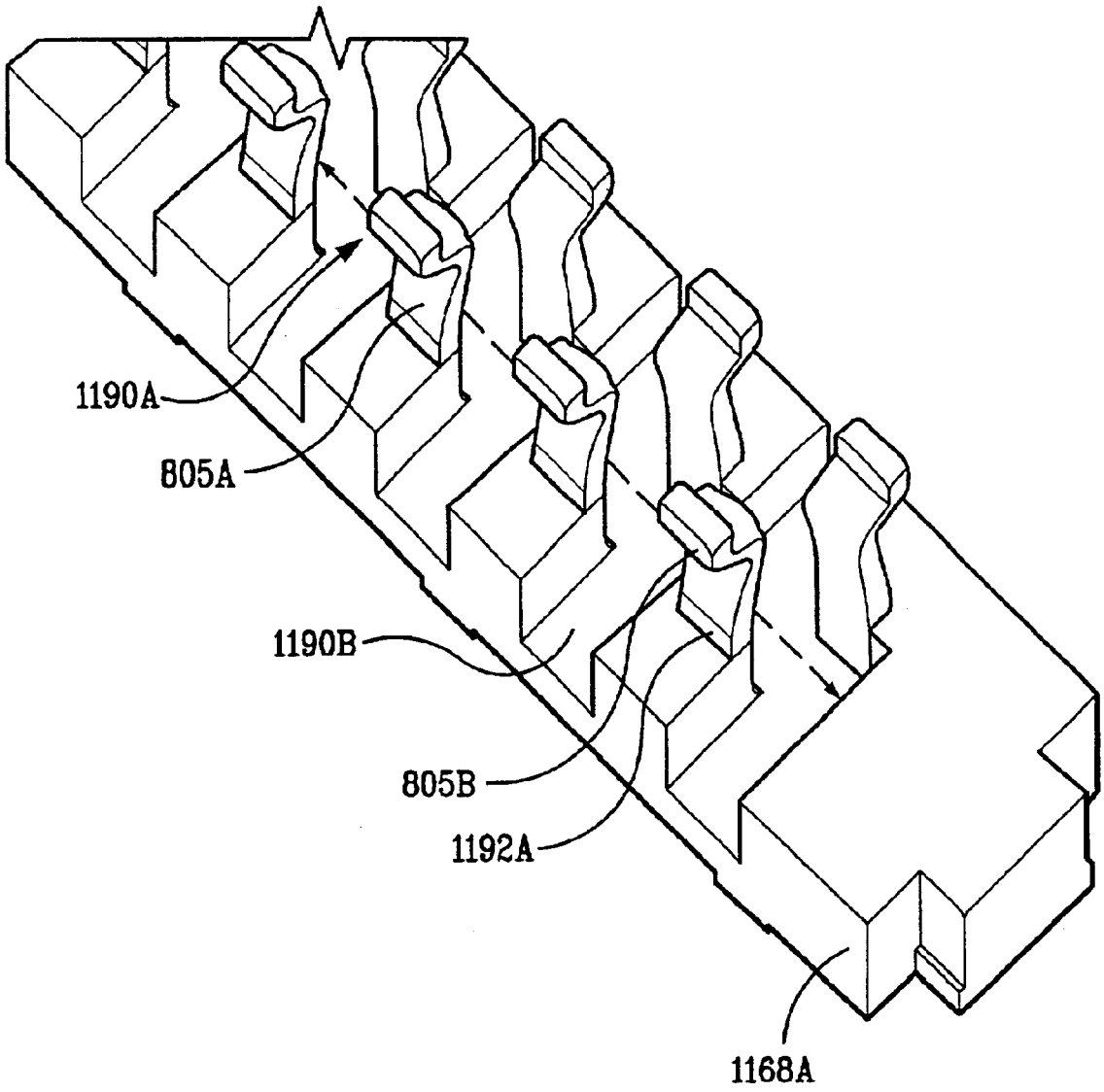
FIG. 10 is a top perspective view of the contact assembly of FIG. 9.

In another embodiment of the invention, the core pins are used to create a continuous open section through the center of the contact row of a determined depth and position that will result in one continuous core having a desired depth and position. Such an embodiment is shown in FIGS. 9 and 10. As shown in FIGS. 9 and 10, a single core 1190A extends along the center of contact block 1168A. Additionally, cores 1190B are formed between adjacent terminals 805A and 805B.

Figure 7:
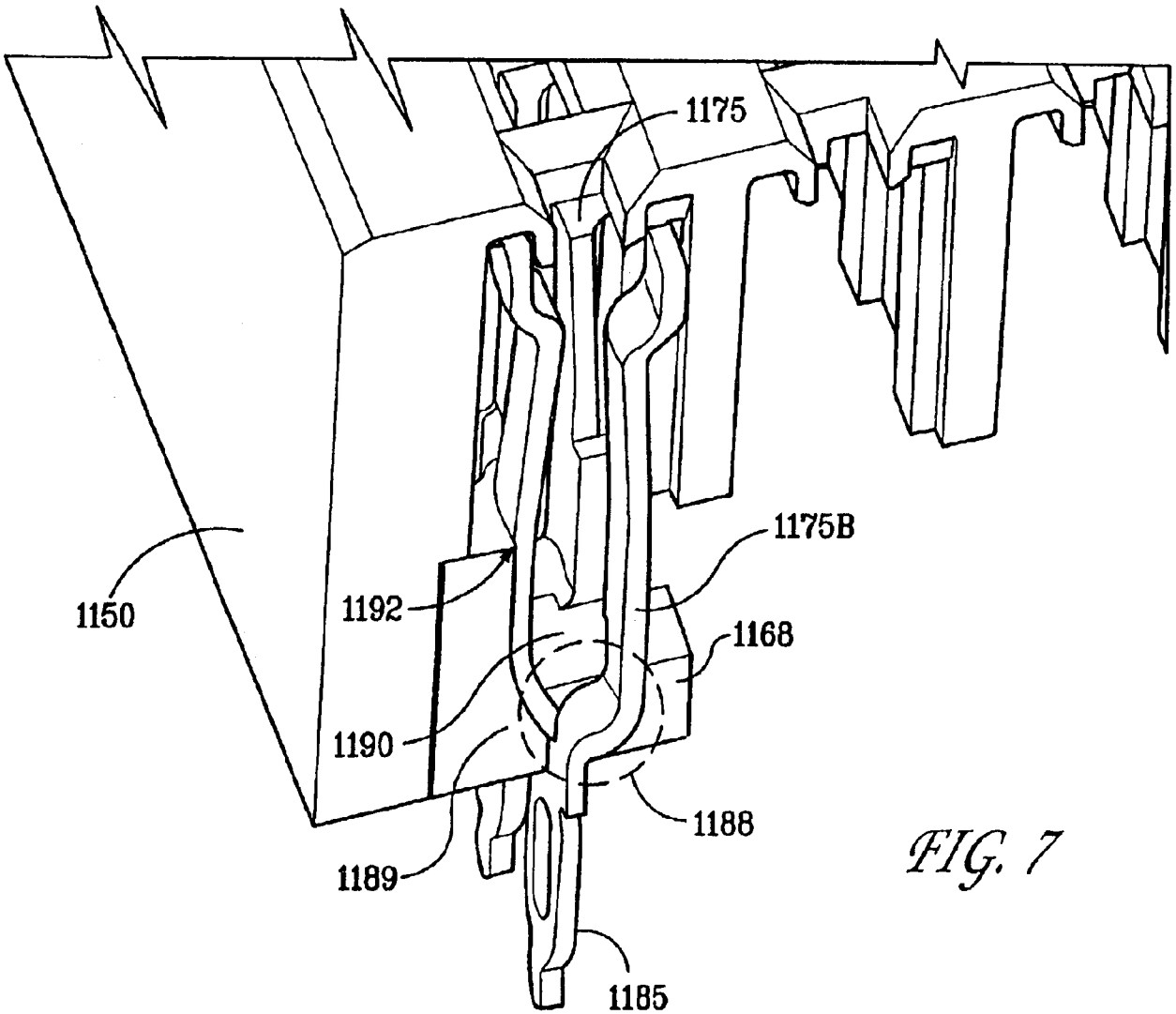
FIG. 7 is a cross sectional view of a receptacle portion in accordance with one aspect of the invention.

FIG. 7 shows a cross section of a receptacle contact assembly in accordance with the invention and contained in receptacle housing 1150. As shown, ground contacts 1175B are dual beam contacts for accepting a corresponding ground contact from plug connector 102. Ground contacts 1175B also have an eye-of-the-needle configuration for insertion into an electrical device (not shown) such as device 110 shown in FIG. 1. The eye-of-the-needle configuration provides an oversized fit in a press-fit mounting application. However, as mentioned above, a surface mount configuration is possible.

Also shown in FIG. 7 is an encapsulated portion 1188 of ground contact 1175B. In this manner, the encapsulated portion 1188 is contained within contact block 1168. The encapsulated formed area may be a deformation in the contact terminal, such as an integral bend or kink in the terminal. The deformation may also be a separate barb attached to the terminal and contained in the contact block.

In one embodiment, the encapsulated portion is formed by using insert molding. In this manner, the contact terminals are stamped formed with a deformation portion positioned in a manner such that when the contact block 1168 is formed, the deformation area 1188 is encapsulated in the contact block 1168. Such a portion increase the mechanical integrity of the ground contact and reduces mechanical breakage when the receptacle is mated with either device such as device 110 or plug connector 102. The encapsulated formed area may vary without departing from the scope of the present invention.

Figure 11:
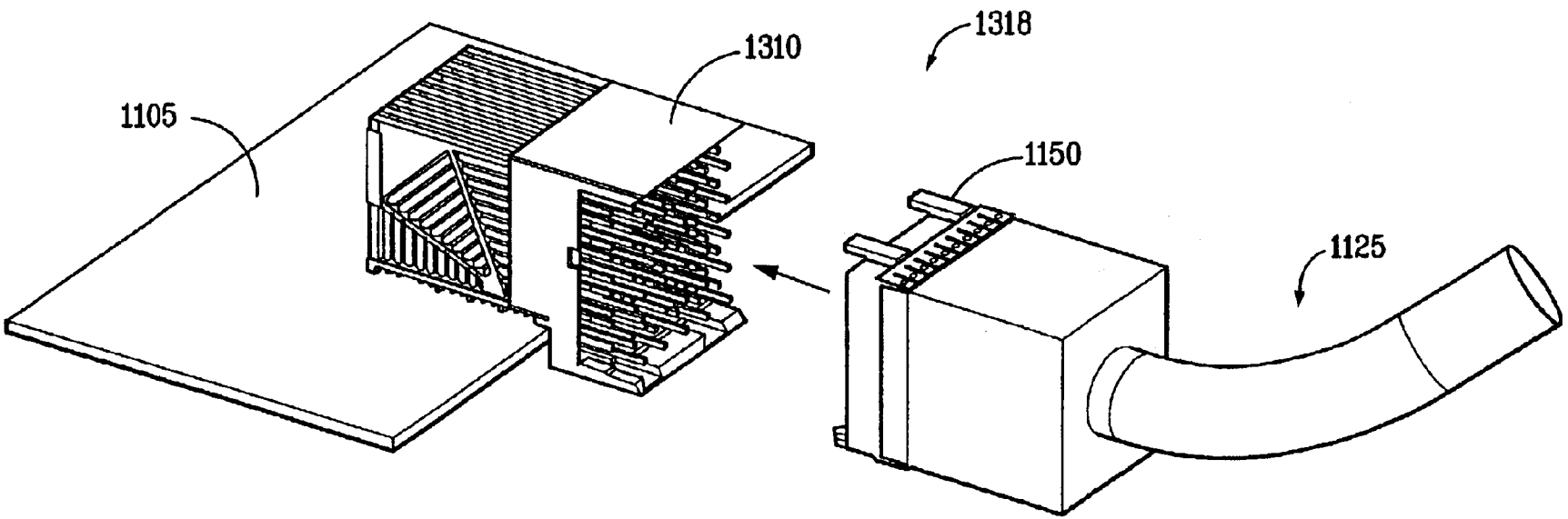
FIG. 11 is a perspective view of a connector in accordance with another embodiment of the invention.

FIG. 11 is a perspective view of a connector system 1318 in accordance with another embodiment of the invention. As shown, connector 1310 and receptacle 1150 are used in combination to connect an electrical device, such as circuit board 1105 to a cable 1125. Specifically, when connector 1310 is mated with receptacle 1315, an electrical connection is established between board 1305 and cable 1325. Cable 1325 can then transmit signals to any electrical device (not shown) suitable for receiving such signals.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. A contact assembly comprising:

an insert molded contact block;

a dual beam signal contact terminal extending through the contact block; and a dual beam ground contact terminal extending through the contact block;

wherein the contact block includes a well disposed between the beams of the dual beam ground contact terminal.

2. The contact assembly of claim 1, wherein the ground contact terminal has an encapsulated formed area within the contact block.

3. The contact assembly of claim 1, wherein the signal contact terminal has an encapsulated formed area within the contact block.

4. The contact assembly of claim 1, further comprising a second signal contact, wherein the signal contacts and the ground contact are disposed in signal-signal-ground configuration.

5. The contact assembly of claim 1, wherein the well has a well sidewall, the well sidewall contacting a portion of at least one of the beams of the ground contact terminal and defines a fulcrum point thereof.

6. A receptacle assembly comprising;

a housing; and a plurality of contact assemblies disposed within the housing, each contact assembly comprising:

an insert molded contact block;

a first plurality of dual beam contact terminals extending through the contact block, wherein the first plurality of dual beam contact terminals are signal contacts; and a second plurality of dual beam contact terminals extending through the contact block, wherein the second plurality of dual beam contact terminals are ground contacts;

wherein the contact block includes a well disposed between the beams of each of the second plurality of dual beam contact terminals.

7. The receptacle of claim 6, wherein the signal contacts and the ground contacts are disposed in signal-signal-ground configuration within the contact block.

8. The contact assembly of claim 6, wherein each well has a well sidewall, the well sidewall contacting a portion of at least one of the beams of the second plurality of the contact terminals and defines a fulcrum point thereof.

9. An electrical connector comprising:

a plug comprising:

a plug housing; and a plurality of contacts disposed within the plug housing wherein the contacts include ground contacts and signal contacts, the ground contacts extending at a first distance from the housing and the signal contacts extending a second distance from the plug housing; and a receptacle removably connected to the plug comprising:

a receptacle housing; and a plurality of contact assemblies disposed within the receptacle housing, each contact assembly comprising:

an insert molded contact block;

a plurality of dual beam signal contact terminals extending through the contact block; and a plurality of dual beam ground contact terminals extending through the contact block;

wherein the contact block includes a core disposed between the beams of each of the second plurality of dual beam contact terminals and the core defines a space capable of receiving a distal portion of each ground contact in the plug thereby enabling the signal contacts of the plug to mate with the signal contacts of the receptacle after the ground contacts of the plug mate with the ground contacts of the receptacle.

10. The electrical connector of claim 9, wherein each of the second plurality of contact terminals has an encapsulated formed area within the contact block.

11. The electrical connector of claim 9, wherein each of the first plurality of contact terminals has an encapsulated formed area within the contact block.

12. The electrical connector of claim 9, wherein the core has a core sidewall, the core sidewall contacting a portion of at least one of the beams of the ground contact terminals of the receptacle for defining a fulcrum paint.

13. A contact assembly comprising:

an insert molded contact block; and a plurality of dual beam contact terminals extending through the contact block, wherein the plurality of dual beam contact terminals are ground contacts;

wherein the contact block includes a well disposed between the beams of each of the plurality of dual beam contact terminals for receiving a distal portion of a contact in a complementary plug.

14. The electrical connector of claim 13, wherein the well has a well sidewall, the well sidewall contacting a portion of at least one of the beams of the contact terminals of the receptacle for defining a fulcrum point.

15. A contact assembly comprising:

an insert molded contact block;

a first plurality of dual beam contact terminals extending through the contact block; and a second plurality of dual beam contact terminals extending through the contact block;

wherein the contact block includes a well disposed between the beams of each of the second plurality of dual beam contact terminals, and wherein each well has a well sidewall, the well sidewall contacting a portion of at least one of the beams of the second plurality of the contact terminals and defines a fulcrum point thereof.

16. The contact assembly of claim 15, wherein each of the second plurality of contact terminals has an encapsulated formed area within the contact block.

17. The contact assembly of claim 15, wherein each of the first plurality of contact terminals has an encapsulated formed area within the contact block.

18. The contact assembly of claim 15, wherein the first plurality of dual beam contact terminals are signal contacts and the second plurality of dual beam contact terminals are ground contacts.

19. The contact assembly of claim 18, wherein the signal contacts and the ground contacts are disposed in signal-signal-ground configuration.

20. A receptacle assembly comprising:

a housing; and a plurality of contact assemblies disposed within the housing, each contact assembly comprising:

an insert molded contact block;

a first plurality of dual beam contact terminals extending through the contact block; and a second plurality of dual beam contact terminals extending through the contact block;

wherein the contact block includes a core disposed between the beams of each of the second plurality of dual beam contact terminals, and wherein each core has a core sidewall, the core sidewall contacting a portion of at least one of the beams of the second plurality of the contact terminals and defines a fulcrum point thereof.

21. The receptacle of claim 20, wherein the first plurality of dual beam contact terminals are signal contacts and the second plurality of dual beam contact terminals are ground contacts.

22. The receptacle of claim 21, wherein the signal contacts and the ground contacts are disposed in signal-signal-ground configuration within the contact block.

23. A contact assembly comprising:

an insert molded contact block; and a plurality of dual beam contact terminals extending through the contact block;

wherein the contact block includes a well disposed between the beams of each of the plurality of dual beam contact terminals far receiving a distal portion of a contact in a complementary plug, and wherein the well has a well sidewall, the well sidewall contacting a portion of at least one of the beams of the contact terminals of the receptacle for defining a fulcrum point.

* * * * *